US009573036B2

(12) United States Patent
Markham

(10) Patent No.: US 9,573,036 B2
(45) Date of Patent: Feb. 21, 2017

(54) PORTABLE TRAINING DEVICE

(71) Applicant: Philip P. Markham, Birmingham, AL (US)

(72) Inventor: Philip P. Markham, Birmingham, AL (US)

(73) Assignee: NINETYNET LLC, Birmingham, AL (US)

( * ) Notice: Subject to any disclaimer, the term of this patent is extended or adjusted under 35 U.S.C. 154(b) by 0 days.

(21) Appl. No.: 14/584,302

(22) Filed: Dec. 29, 2014

(65) Prior Publication Data

US 2015/0196819 A1 Jul. 16, 2015

Related U.S. Application Data

(60) Provisional application No. 61/926,911, filed on Jan. 13, 2014.

(51) Int. Cl.

| | |
|---|---|
| ***A63B 69/00*** | (2006.01) |
| ***A63B 71/06*** | (2006.01) |
| *A63B 63/00* | (2006.01) |

(52) U.S. Cl.

CPC ..... *A63B 69/002* (2013.01); *A63B 71/0622* (2013.01); *A63B 63/00* (2013.01); *A63B 63/003* (2013.01); *A63B 63/004* (2013.01); *A63B 2071/0625* (2013.01); *A63B 2102/22* (2015.10); *A63B 2210/50* (2013.01)

(58) Field of Classification Search

CPC ..... A63B 63/004; A63B 63/00; A63B 69/002; A63B 69/0026; A63B 63/003; A63B 2024/0046; A63B 2024/005

USPC ..... 473/446; 273/398–402

See application file for complete search history.

(56) References Cited

U.S. PATENT DOCUMENTS

| | | | | |
|---|---|---|---|---|
| 3,944,223 | A * | 3/1976 | Bromwell | A63B 63/00 273/126 R |
| 4,921,257 | A * | 5/1990 | Heller | A63B 63/00 473/446 |
| 5,181,725 | A * | 1/1993 | Leras | A63B 63/004 473/446 |
| 5,503,402 | A * | 4/1996 | Moss, Jr. | A63B 63/004 273/400 |
| 5,628,515 | A * | 5/1997 | Levy | A63B 63/06 273/392 |
| 5,634,640 | A * | 6/1997 | McCarrel | A63B 63/00 273/127 B |
| 5,888,153 | A | 3/1999 | Masin | |
| 6,264,572 | B1 * | 7/2001 | Matheson | A63B 69/0026 273/402 |
| 6,692,384 | B2 * | 2/2004 | Bains | A63B 63/004 473/446 |

(Continued)

FOREIGN PATENT DOCUMENTS

GB 2483067 A1 2/2012

*Primary Examiner* — Mark Graham

(74) *Attorney, Agent, or Firm* — Roy Kiesel Ford Doody & Thurmon

(57) ABSTRACT

A portable training device and training method is disclosed. The portable training device includes a non-linear section. The non-linear section is configured to form a target area that substantially imitates the reach of a goalkeeper. The training method includes covering a portion of an opening of a goal with the portable training device to create a target area configured to substantially imitate the reach of a goalkeeper.

17 Claims, 10 Drawing Sheets

(56) References Cited

U.S. PATENT DOCUMENTS

| | | | | |
|---|---|---|---|---|
| 7,037,219 | B2 * | 5/2006 | Pakieser | A63B 69/002 473/422 |
| 7,134,976 | B1 * | 11/2006 | Smith | A63B 24/0021 273/400 |
| 7,252,604 | B2 * | 8/2007 | Birss | A63B 63/003 273/392 |
| 7,651,416 | B2 * | 1/2010 | Farquhar | A63B 63/004 273/398 |
| 8,187,123 | B2 * | 5/2012 | Pettys | A63B 63/00 273/402 |
| 8,961,339 | B2 * | 2/2015 | Littman | A63B 69/0097 473/422 |
| 9,120,000 | B2 * | 9/2015 | Weston | A63B 63/004 |
| 2003/0199342 | A1 | 10/2003 | Birss | |
| 2008/0214331 | A1 * | 9/2008 | Talafous | A63B 69/0026 473/446 |
| 2009/0036238 | A1 * | 2/2009 | Sheehan | A63B 63/003 473/446 |
| 2009/0181810 | A1 * | 7/2009 | Stephenson | A63B 63/004 473/446 |
| 2012/0046133 | A1 | 2/2012 | Pettys et al. | |
| 2013/0023362 | A1 * | 1/2013 | Siefker | A63B 63/004 473/446 |
| 2014/0045628 | A1 * | 2/2014 | Krohl | A63B 63/00 473/446 |

* cited by examiner

PORTABLE TRAINING DEVICE

CROSS-REFERENCE TO RELATED APPLICATION

This application claims the benefit of U.S. Provisional Application No. 61/926,911, filed Jan. 13, 2014. Each patent application identified above is incorporated here by reference in its entirety.

BACKGROUND OF THE INVENTION

Field of the Invention

The present disclosure relates to subject matter comprising a means adapted and intended to enable a player of a playing field or court game to improve or perfect his or her skills in the playing of any aspect of the game or sport, particularly subject matter configured to enable a practicing or training player to improve or perfect his or her play of any aspect of a playing field or court game involving impelling, sliding, rolling, propelling, kicking, throwing, or otherwise projecting a game projectile into or through an apertured or pocketed goal or target.

Description of Related Art

Portable training devices for an apertured or pocketed goal are often used to enable a player of a playing field or court game to improve or perfect his or her skills. Typically, the portable training device is attached to the goal or otherwise positioned near the goal to form a target area in a desired area of the goal that is generally considered to be a difficult area for a goalkeeper to defend. For example, in soccer or hockey, the portable training device is often attached to the goal or otherwise positioned near the goal to form a target area in the upper and lower corners of the goal opening. The upper and lower corners of the goal are commonly known as upper 90s and lower 90s.

Although many of the existing portable training devices can form a target area in the goal opening, these existing devices typically do not form a target area that accounts for the reach of a goalkeeper. For example, in a typical goalkeeping situation, the reach of the goalkeeper can be approximated by the shape of the goalkeeper's foot or outstretched hand, which is often non-linear. However, in many existing devices, the boundaries that define the target area typically do not approximate the goalkeeper's reach.

In addition, many existing portable training devices require a significant amount of time to assemble, disassemble, secure to the goal, or position in an area near the goal opening. An individual typically wants to pack-up equipment and leave the practice field quickly, particularly a fatigued player or coach following a long practice or training session. For example, many existing portable training devices are constructed from flexible sheets of plastic or fabric that hang from the posts or crossbar of the goal or that must be attached across the whole face of the goal. Further, many existing portable training devices are constructed from materials that do not allow the portable training device to be positioned in many areas of the goal such as the lower corners of the goal opening, i.e., the lower 90s.

Accordingly, there remains a need in the art for a portable training device that can function with a variety of sized goals and be quickly attached to or removed from the goal or the area near the goal opening and that is also capable of enabling an individual to practice aiming at one more desired areas of the goal opening, which are considered the most difficult areas for a goalkeeper to defend, while also capable of substantially imitating the reach of the goalkeeper.

BRIEF SUMMARY OF THE INVENTION

The purpose of the invention is to accomplish at least one of the following objects. An object of this invention is to provide a portable training device and method that can be quickly attached or removed from a goal or area near a goal opening. Another object of this invention is to provide a portable training device and method that is capable of enabling an individual to practice aiming at one or more desired areas which are generally considered the most difficult areas for a goalkeeper to defend. Another object of this invention is to provide a portable training device that is sufficiently rigid to permit the portable training device to serve as a target in the corners of the goal. Another object of this invention is to provide a portable training device and method capable of substantially imitating the reach of the goalkeeper. Still a further object of this invention is to provide a portable training device and method that is capable of being used with a variety of sized goals. Additional objects and advantages of this invention shall become apparent from the ensuing descriptions of the invention.

According to a first aspect of the invention, a portable training device is provided. The portable training device includes a non-linear section. The portable training device is configured to be attached to the goal or otherwise positioned near the goal opening. The non-linear section is configured to form a target area that substantially imitates the reach of a goalkeeper.

According to a second aspect of the invention, a training method is provided. The training method includes covering a portion of an opening of a goal with the portable training device to create a target area configured to substantially imitate the reach of a goalkeeper. The portable training device includes a non-linear section. The portable training device is configured to be attached to the goal or otherwise positioned near the goal opening. The non-linear section is configured to form a target area that imitates the reach of a goalkeeper.

The above brief summary of the invention presents a simplified summary of the claimed subject matter in order to provide a basic understanding of some aspects of the claimed subject matter. This summary is not an extensive overview of the claimed subject matter. It is intended to neither identify key or critical elements of the claimed subject matter nor delineate the scope of the claimed subject matter. Its sole purpose is to present some concepts of the claimed subject matter in a simplified form as a prelude to the more detailed description that is presented below.

Additionally, the above brief summary has outlined rather broadly the features and technical advantages of the present invention in order that the detailed description of the invention that follows may be understood. Additional features and advantages of the invention will be described hereinafter, which form the subject of the claims of the invention. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features, which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE SEVERAL VIEWS OF THE DRAWINGS

The accompanying drawings illustrate preferred embodiments of this invention. However, it is to be understood that these embodiments are not intended to be exhaustive, nor limiting of the invention. These embodiments are but examples of some of the forms in which the invention may be practiced.

DETAILED DESCRIPTION OF THE INVENTION

Figure 1:
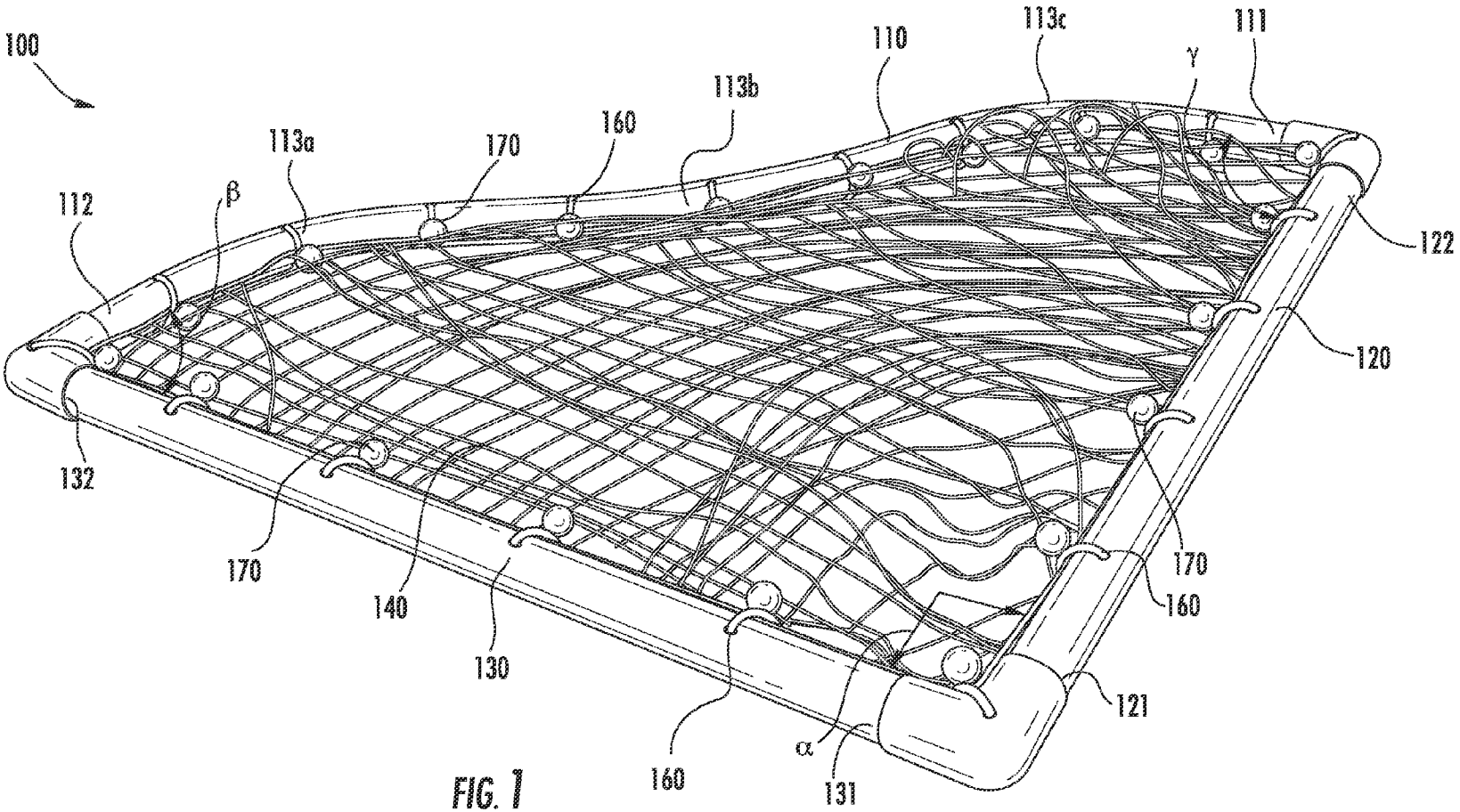
FIG. 1 illustrates an embodiment of a portable training device in accordance with this invention.
Figure 2:
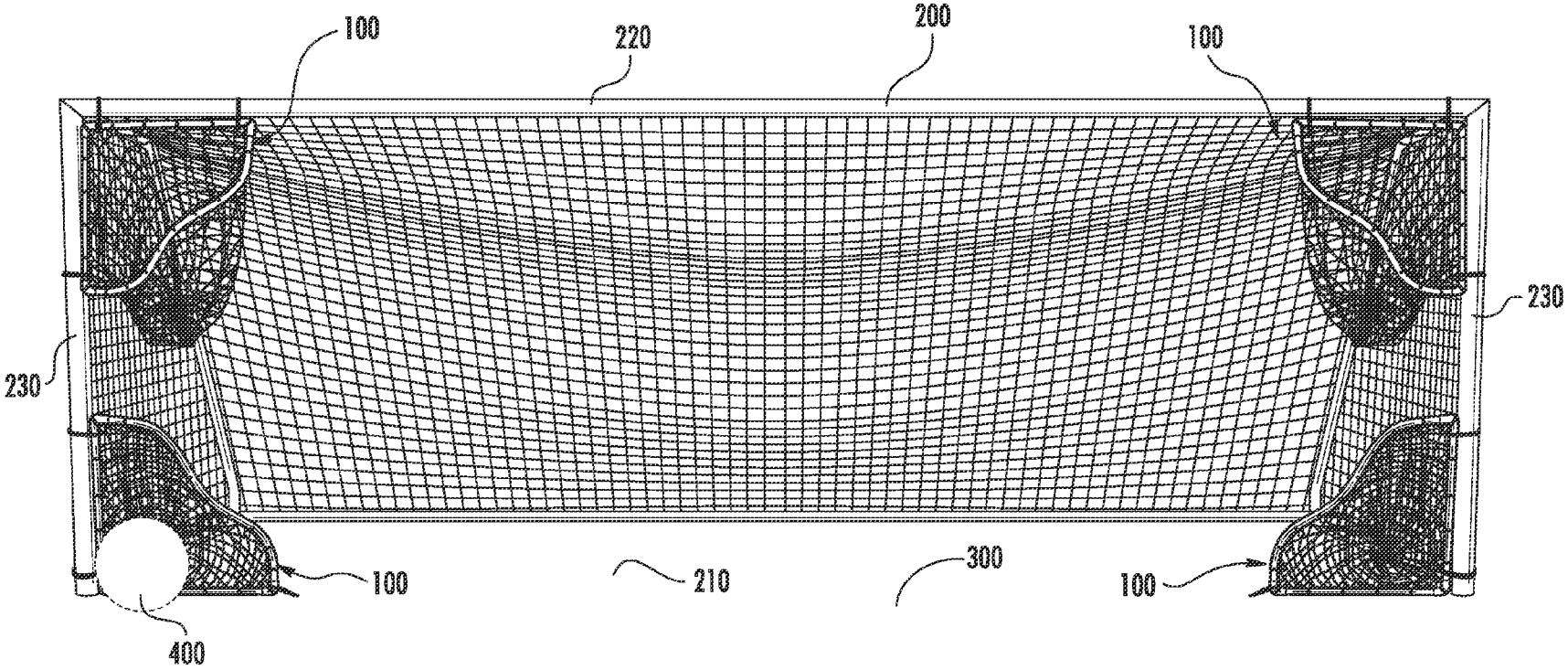
FIG. 2 illustrates the portable training device shown in FIG. 1 in use with a goal.
Figure 3:
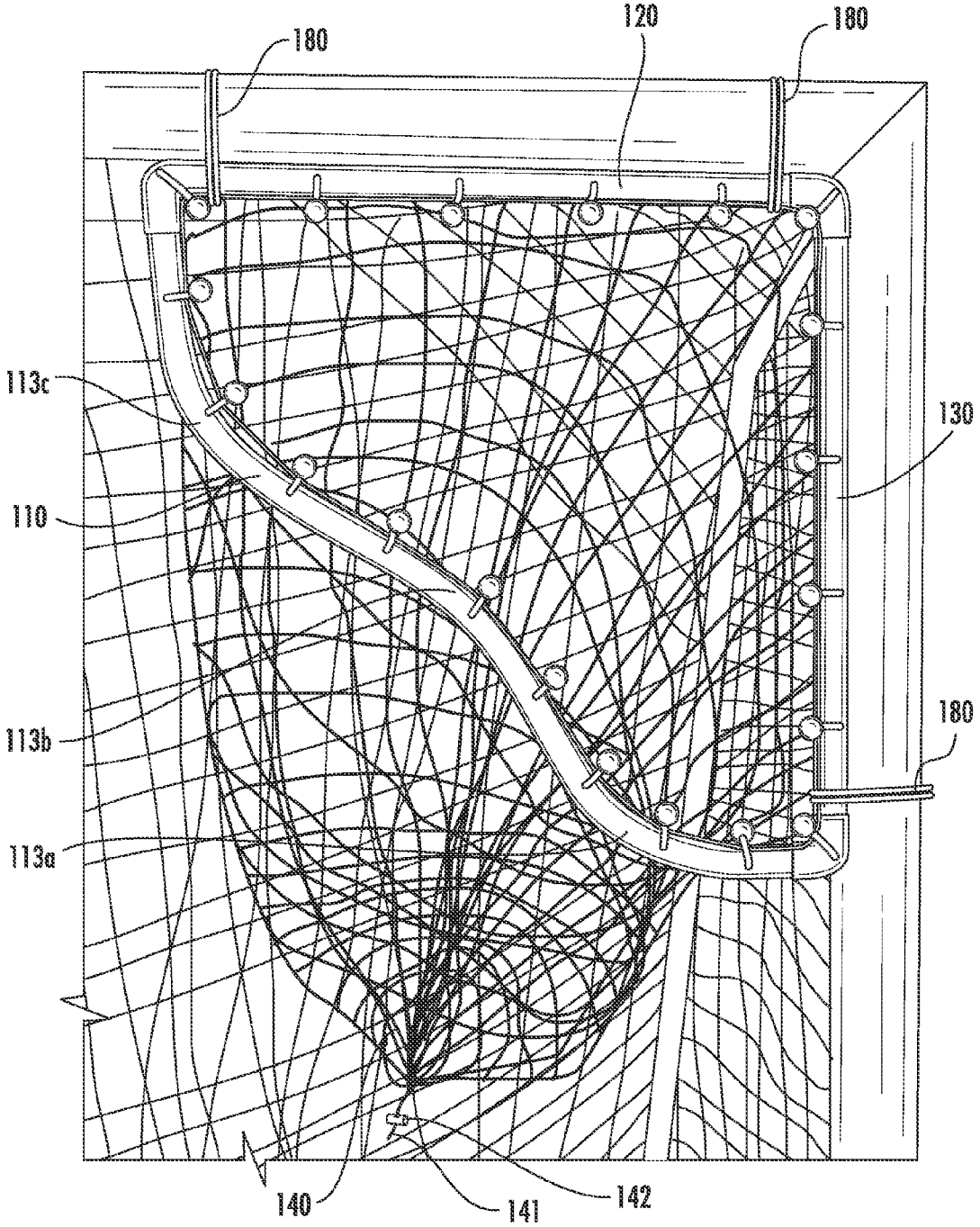
FIG. 3 illustrates the portable training device shown in FIG. 1 in use with a goal.
Figure 4:
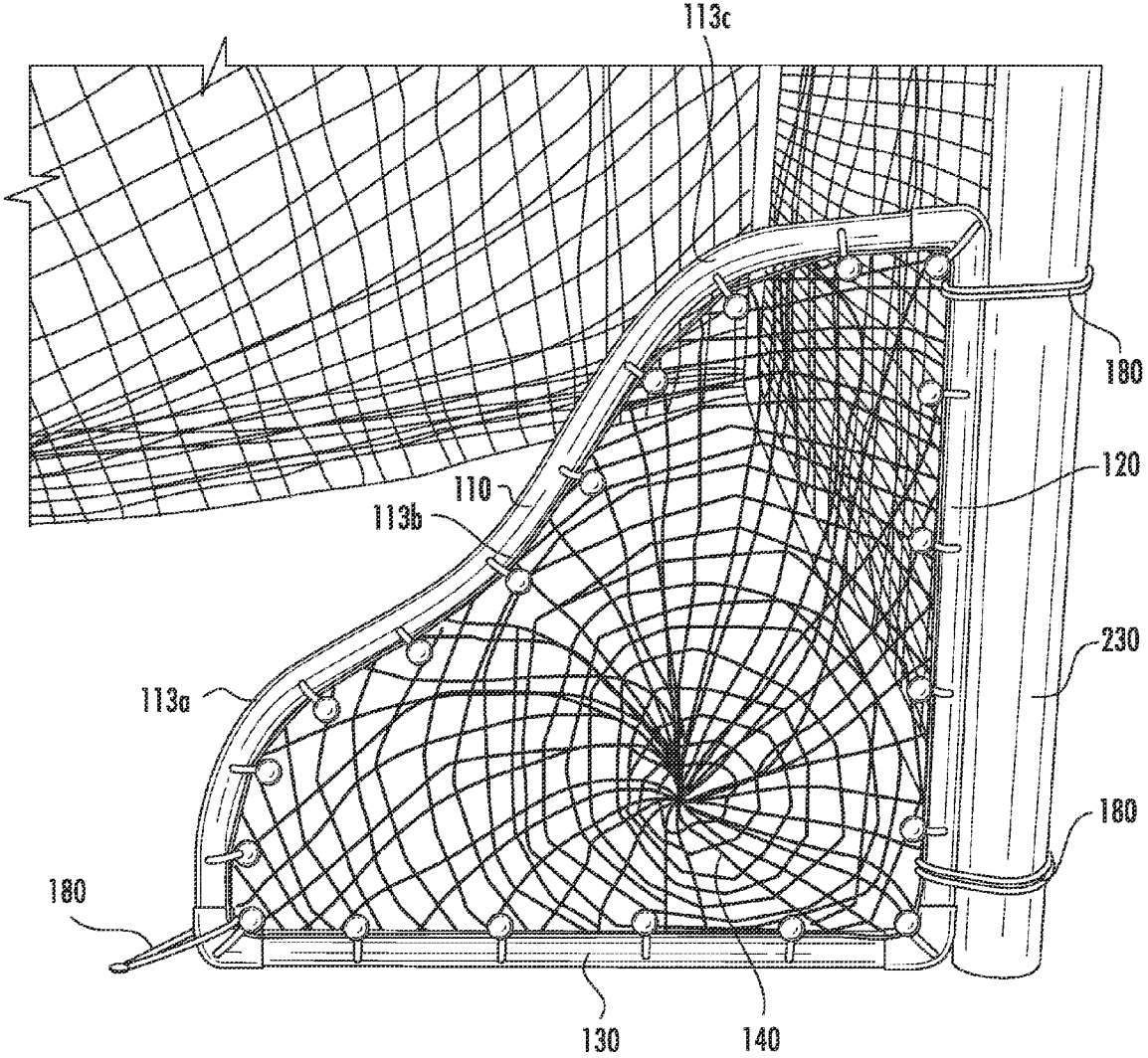
FIG. 4 illustrates the portable training device shown in FIG. 1 in use with a goal.
Figure 5:
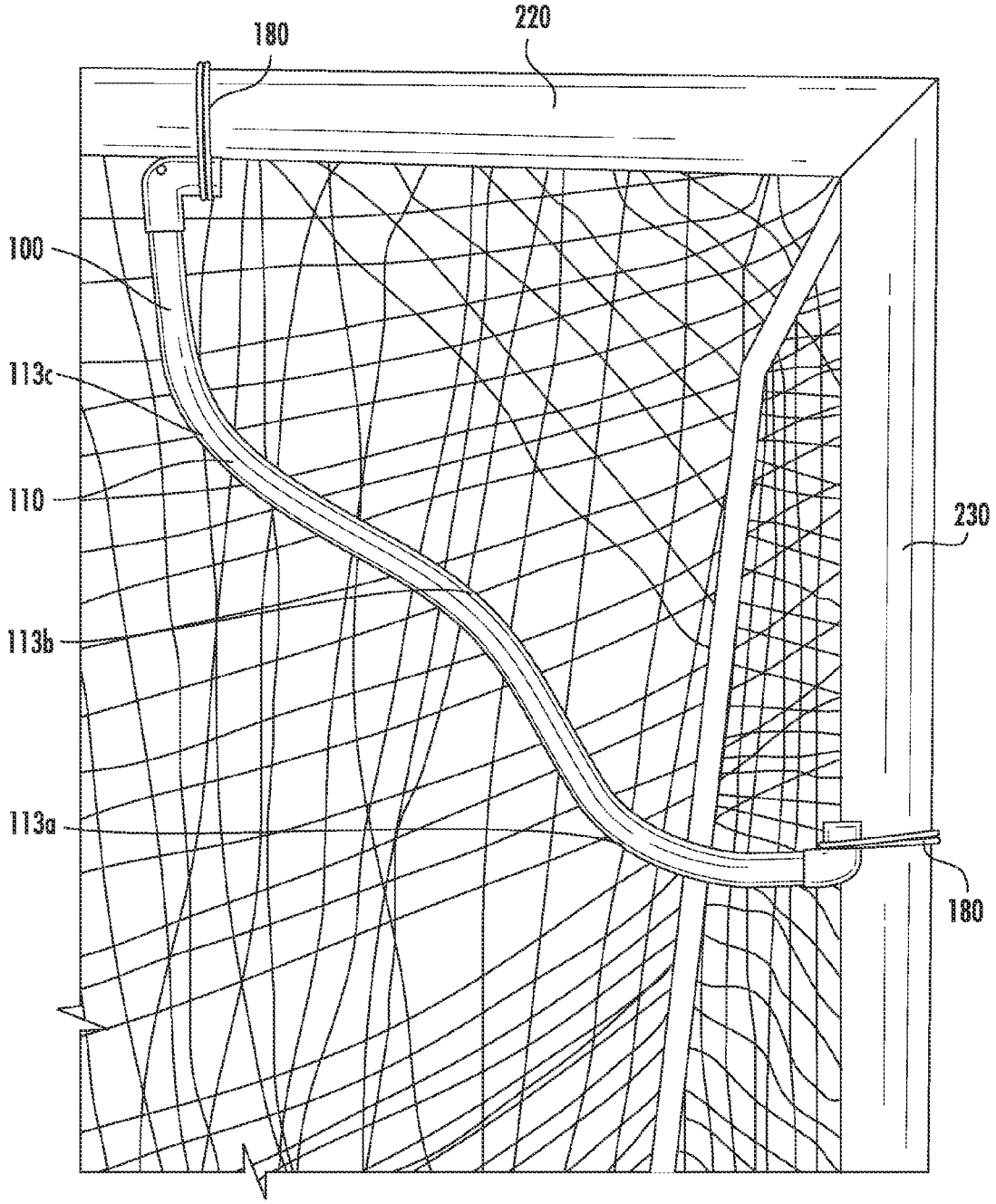
FIG. 5 and FIG. 6 illustrate an alternate embodiment of a portable training device in accordance with this invention in use with a goal.
Figure 6:
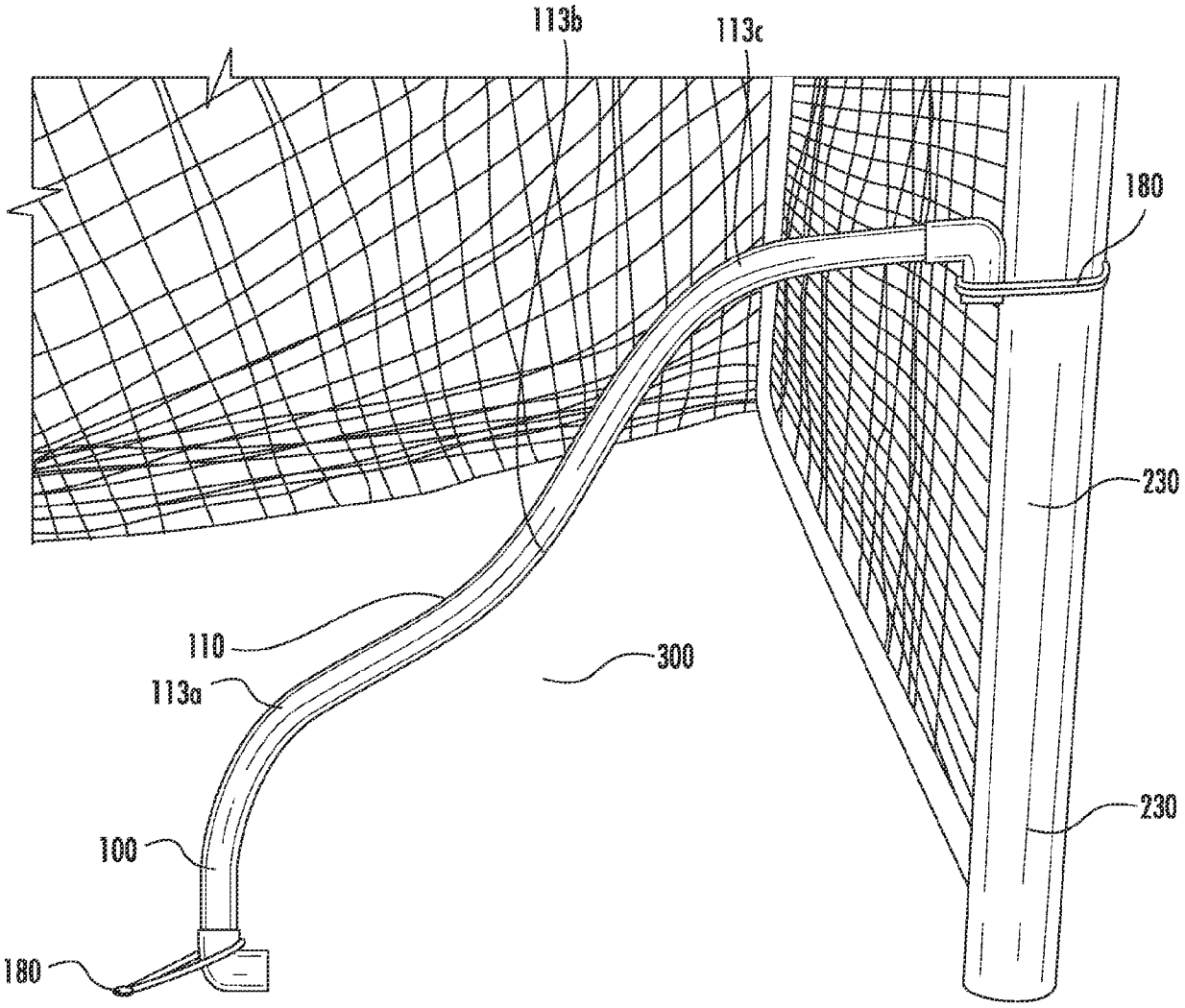
Figure 7:
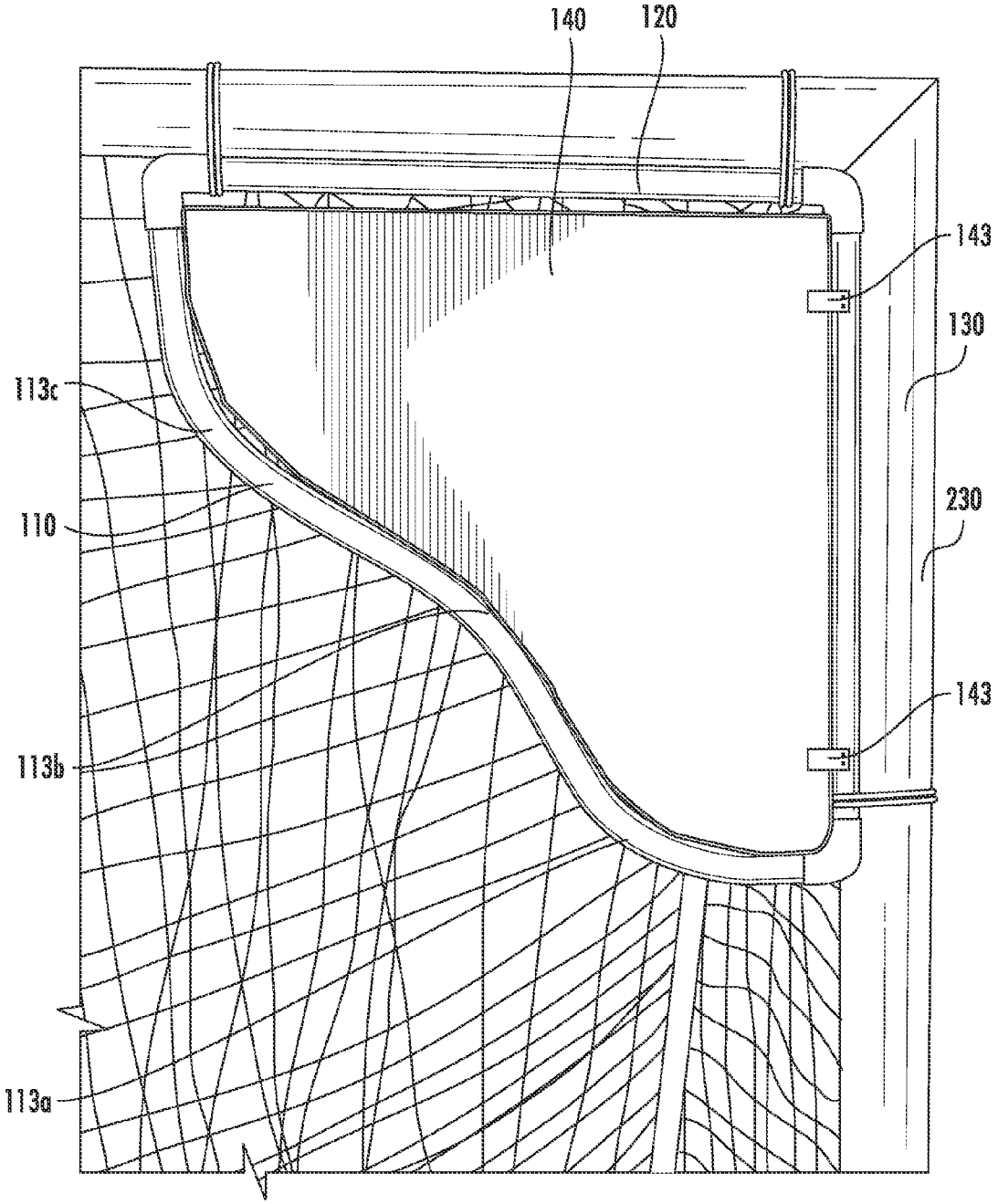
FIG. 7 illustrates an alternate embodiment of a portable training device in accordance with this invention in use with a goal.
Figure 8:
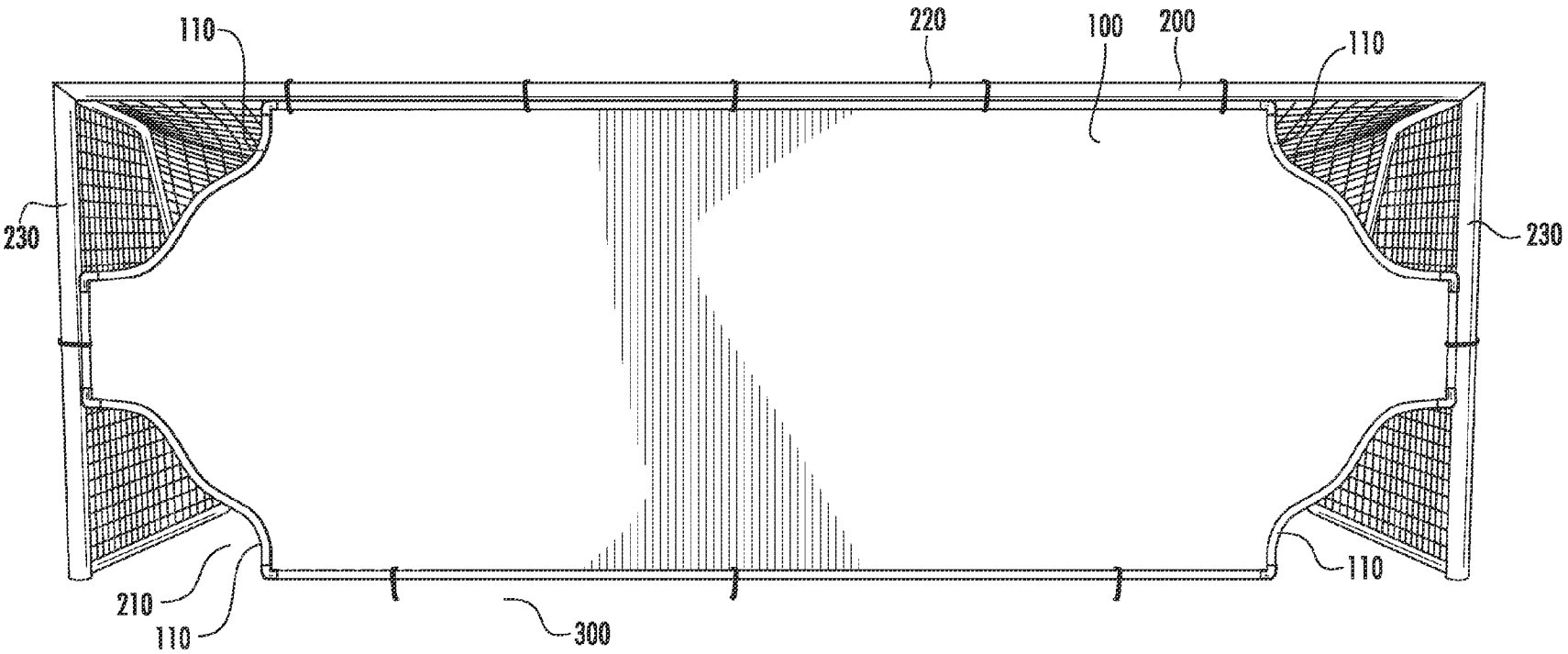
FIG. 8 illustrates an alternate embodiment of a training device in accordance with this invention in use with a goal.
Figure 9:
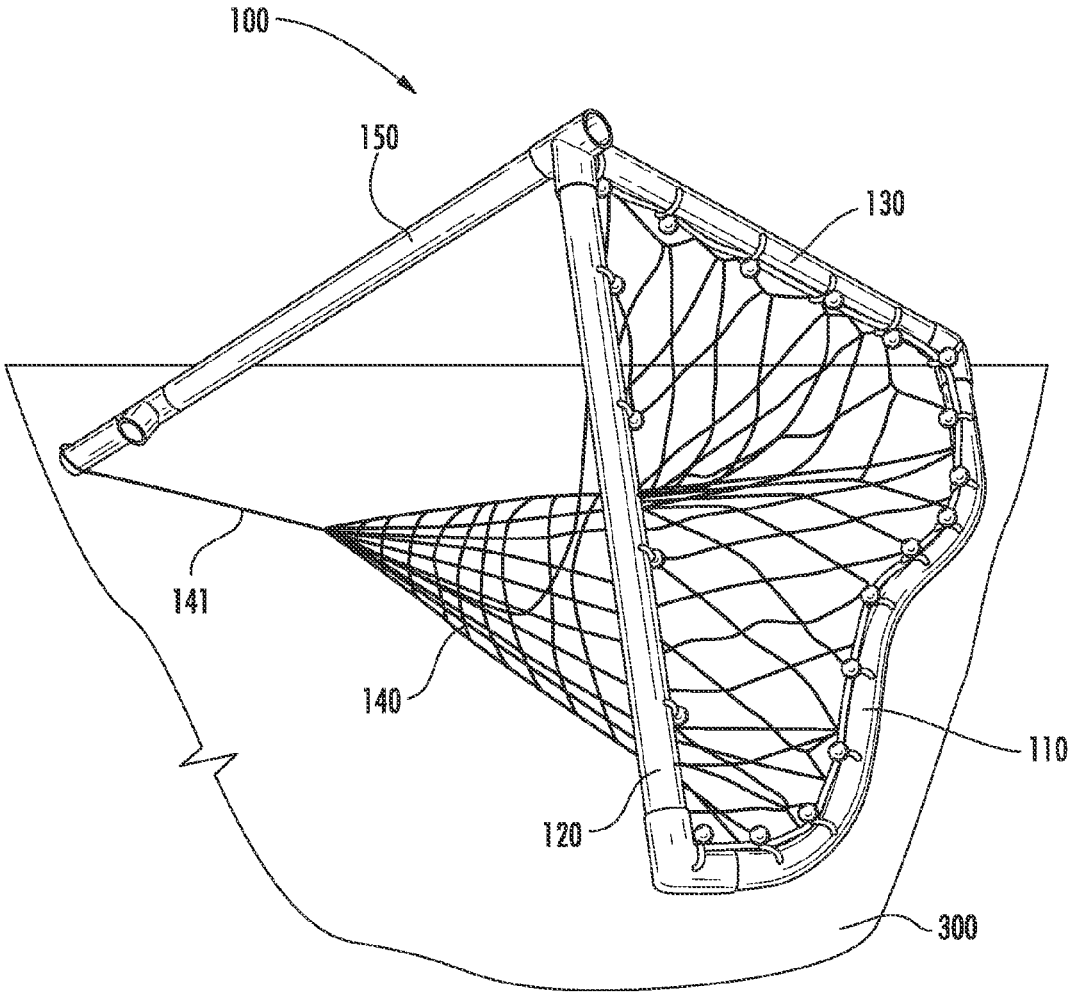
FIG. 9 illustrates an alternate embodiment of a portable training device in accordance with this invention that is self-supporting.
Figure 10:
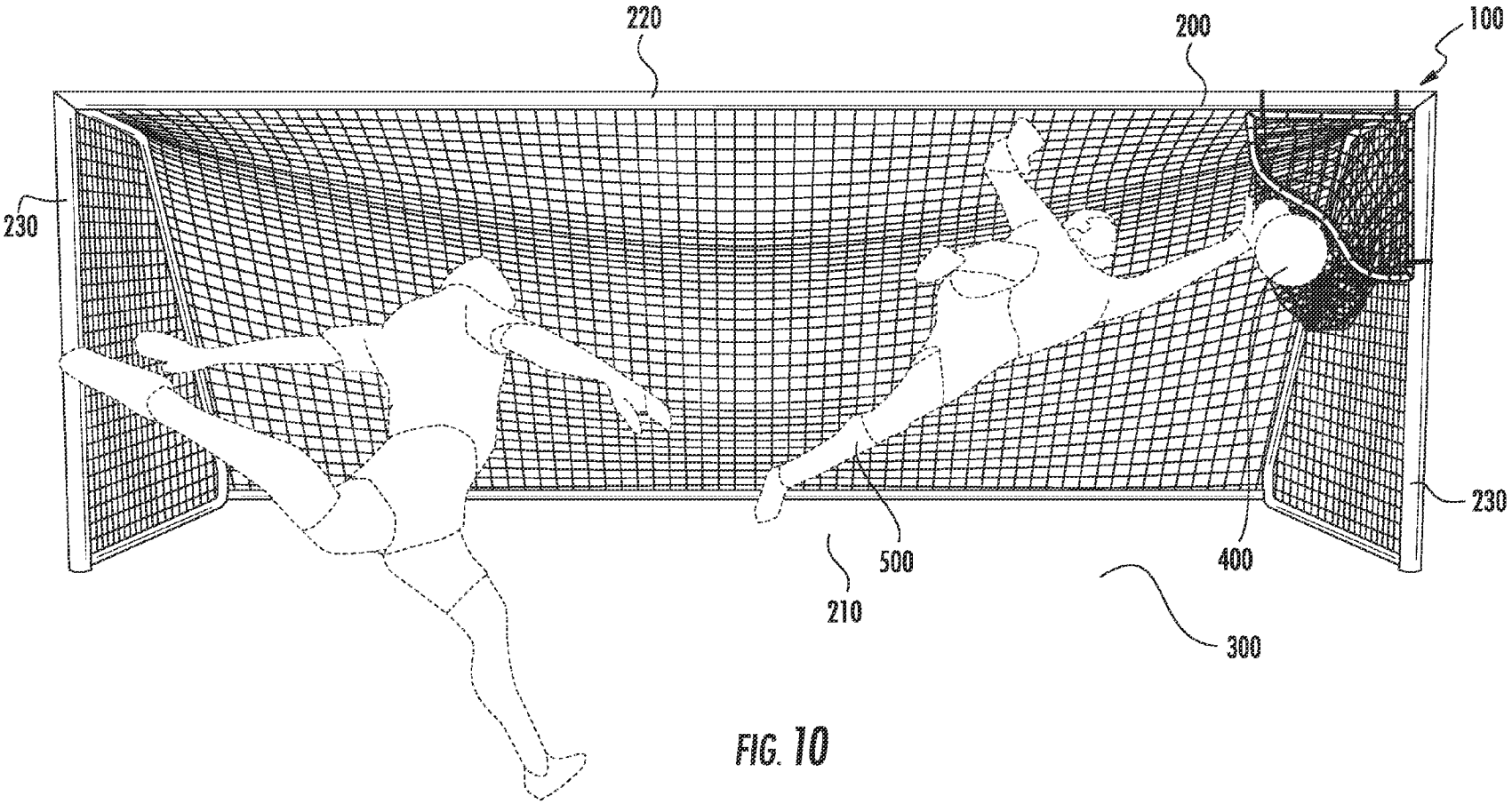
FIG. 10 illustrates the portable training device shown in FIG. 1 in use with a goal.

Without any intent to limit the scope of this invention, reference is made to the figures in describing various embodiments of the invention. FIGS. 1-9 depict various views of a portable training device 100 in accordance with this invention. The portable training device 100 is configured to be removably attached to a goal 200 having an opening 210 or otherwise positioned at an area near the goal opening 210. The portable training device 100 can be attached to the goal 200 or positioned at the area near the goal 200 using one or more goal attachment structures 180. The goal attachment structures 180 are preferably one or more bungee cords to enable quick attachment or removal from the goal 200. In addition, one or more bungee cords are also preferred as the attachment structure 180 because the bungee cord can absorb much of the force of the soccer ball 400 hitting the device 100. For example, when the portable training device 100 is deployed in the lower corners of the goal 200, using a bungee cord in conjunction with a ground stake permits the device to oscillate when the soccer ball 400 strikes the portable training device 100. However, it should be appreciated that the attachment structure 180 can be any conventional means including without limitation ties, clips, nuts and bolts, ties, brackets, straps, stakes, and so forth.

The portable training device 100 comprises a non-linear section, such as a non-linear support member 110, which is configured to substantially imitate the reach of a goalkeeper 500. The non-linear section 110 can comprise an elongated body having a first end 111 and a second end 112. The non-linear section 110 is preferably shaped like a curve or wave having a peak, but the non-linear section 110 can be shaped as desired to substantially imitate or resemble the reach of the goalkeeper 500. In an embodiment, the non-linear section 110 includes at least one peak, but more preferably three peaks 113*a*, 113*b*, 113*c*. The radius of curvature at the peaks 113*a*, 113*b*, 113*c* is preferably at least about 10 to 20 inches, more preferably at least about 12 to 18 inches. In an embodiment, the radius of curvature at the outer peaks 113*a*, 113*c* is about 12 to 13 inches and the radius of curvature at the central peak 113*b* is about 17 to 18 inches.

The non-linear section 110 is configured to form a hole or opening that can function as a target area. In an embodiment, the portable training device 100 can further comprise a first support member 120 and a second support member 130. The non-linear section 110, the first support member 120 and the second support member 130 can be attached together to form the hole, which is preferably substantially triangular shaped. For example, a first end 121 of the first support member 120 can be attached to a first end 131 of the second support member 130 to form a first angle $\alpha$. The first angle cc is about 90 degrees to permit the portable training device 100 to fit in any corner of the goal 200. The non-linear section 110 can be attached to a second end 122 of the first support member 120 and a second end 132 of the second support member 130. A second angle $\gamma$ is formed where the first support member 120 attaches to the non-linear section 110. A third angle $\beta$ is formed where the second support member 130 attaches to the non-linear section 110. The second angle $\gamma$ and the third angle $\beta$ should be at least about 90 degrees or greater to permit a soccer ball 400 to pass through the target area, particularly to permit the ball 400 to pass through the corners of the target area of the portable training device 100. The non-linear section 110, the first support member 120, and the second support member 130 are preferably attached together using couplings, but can be attached together using any conventional means including without limitation couplings, nuts and bolts, screws, clips, ties, and so forth.

In an alternate embodiment, the non-linear section 110 can be attached to the goal 200 and/or a surrounding structure or surface to form the frame. For example, the non-linear section 110 can be attached to a horizontal post 220 and vertical post 230 of the goal 200 to form the hole that functions as the target area. Alternatively, the non-linear section 110 can be attached to the ground 300 near the goal 200 and the vertical post 230 to form the hole that functions as the target area. Thus, the horizontal post 220 of the goal 200, vertical post 230 of the goal 200 or ground 300 near the goal 200 can serve as the first support member 120 or second support member 130 as desired.

The non-linear section 110, the first support member 120, and the second support member 130 should be constructed from a sufficiently rigid material that permits the portable training device 100 withstand the repeated impact of a struck ball 400 without deforming. The non-linear section 110 is preferably constructed from a material having a modulus of elasticity of about 2.3-4.1 gigapascals (GPa). In an embodiment, the non-linear section 110 comprises polyvinylchloride (PVC) pipe having a nominal pipe size of about 1.25 inches with an outside diameter of about 1.66 inches. Other suitable materials of construction for the support members 110, 120, 130 include without limitation wood, plastics such as polyvinylchloride (PVC), or metals or metal alloys such as carbon steel.

The portable training device 100 can further comprise a positive feedback mechanism 140 configured to increase the positive feedback an individual receives from shooting the ball 400 through the target area of portable training device 100. In an embodiment, the positive feedback mechanism 140 can comprise a net. When an individual shoots the ball 400 through the hole of the portable training device 100, the action of the ball 400 striking the net can produce a "swish" sound, which can increase the positive feedback to an individual. The net can be open or closed using a drawstring 141 and a spring clip 142 configured to slide over the drawstring. To close the net, the net is pulled closed using the drawstring 141 and the spring clip 142 is positioned to maintain the net in the closed position. In the closed position, the net can also retain or catch the ball 400 when it is shot through the target area. To open the net, the spring clip 142 is removed and the net is pulled open using the drawstring 141. In the open position, the net can permit the ball 400 to pass through the target area of the portable training device without being retained. The net can be attached to the portable training device by any conventional means including without limitation clips, ties, clamps and so forth. In an embodiment, the non-linear section 110, the first support member 120, and the second support member 130 can include one or more apertures 160 configured to permit attachment of the net to the portable training device 100. The net can include attachment structures 170 such as ties that are passed through the one or more apertures 160 and tied to secure the net in position.

In another embodiment, the positive feedback mechanism 140 can comprise a mark. The mark is preferably shaped to be slightly smaller than the target area. The mark can be pivotally attached by a connector 143 to the portable training device 100 so that when the ball 400 is shot through the target area the mark moves from a first position to a second position to allow the ball 400 to pass through the target area. Once the ball 400 passes through the target area, the mark moves from the second position back to the first position. The mark can comprise any sufficiently rigid material capable of withstanding the repeated impact from a struck ball 400 including without limitation rubber, wood, plastic, metals and metal alloys and combinations thereof.

The portable training device 100 can further comprise a stabilization support 150, which is configured to permit the portable training device 100 to be self-supporting. The stabilization support 150 is preferably about equal to the distance from the point where the first support 120 attaches to the second support 130 to the outer peaks 113*a*, 113*c*. If the stabilization support 150 is too short, the target area will be too small to kick a ball through because the target area will be almost parallel to the ground. On the other hand, if the stabilization support 150 is too long, the portable training device 100 will become unstable and topple over when struck by the ball. The stabilization member 150 can be attached to the portable training device 100, preferably attached at a corner of the portable training device 100, to form a tripod. In an embodiment, the stabilization member 150 can comprise one of the support members 110, 120, 130 from another portable training device 100. For example, multiple portable training devices 100 can be used by an individual around the goal 200 at the same time. Thus, the support member, such as the first support member 120 or the second support member 130, from one portable training device can be used as the stabilization member 150 for the other portable training device. The stabilization support 150 is preferably attached to the portable training device 100 with a coupling, but the stabilization support can be attached to the portable training device 100 using any conventional means including without limitation nuts and bolts, screws, clips, ties, and so forth. The stabilization support 150 should be constructed from a material that is sufficiently rigid to support the portable training device 100. Suitable materials of construction for the stabilization support 150 include without limitation the same materials used to construct the non-linear section 110.

In another alternate embodiment, the portable training device 100 can be a covering removably attached to the goal 200. The covering can be attached to the goal 200 using any conventional attachment means including without limitation ties, cords, straps and so forth. The covering can comprise a single sheet of material or netting that is configured to substantially obscure a portion of the opening 210 of the goal 200 thereby forming a target area when the covering is attached to the goal 200. The covering comprises one or more a non-linear sections 110 that are configured to substantially imitate the reach of the goalkeeper 500. When the covering is attached to the goal 200 or positioned near the goal 200, the non-linear section 110 forms one or more holes that serve as the target area. For example, the non-linear section 110 together with the horizontal post 220 and the vertical post 230 of the goal 200 can form the hole. Similarly, the non-linear section 110 together with the vertical post 230 of the goal 200 and the ground 300 can form the hole.

Similar to the non-linear section 110 in the other embodiments described above, the non-linear section 110 is preferably shaped like a curve or wave having a peak, but the non-linear section 110 can be shaped as desired to substantially imitate or resemble the reach of the goalkeeper 500. In an embodiment, the non-linear section 110 includes at least one peak, but preferably three peaks 113*a*, 113*b*, 113*c*. The radius of curvature at the peaks 113*a*, 113*b*, 113*c* of the curve is preferably at least about 10 to 20 inches, more preferably at least about 12 to 18 inches. In an embodiment, the radius of curvature at outer peaks 113*a*, 113*c* is about 12 to 13 inches and the radius of curvature at the central peak 113*b* is about 17 to 18 inches. The covering can be constructed from any material suitable for substantially obscuring a portion of the opening 210 of the goal 200 and inhibiting the passage of the ball 400 through the covering. Suitable materials of construction for the covering include fabric, rubber, plastic and so forth.

In operation, the portable training device 100 is attached to the goal 200 or otherwise positioned near the goal 200. The portable training device 100 can be positioned in the upper corners of the goal 200 by attaching the portable training device 100 to the horizontal post 220 and the vertical post 230 of the goal 200. The portable training device 100 can be positioned in the lower corners of the goal 200 by attaching the portable training device 100 to the ground 300 and the vertical post 230 of the goal 200. However, the portable training device 100 can also be secured to the goal 200 or positioned near the goal 200 in a variety of areas. For example, the portable training device 100 could be positioned along the ground 300 around the goal 200 by securing the portable training device 100 to the vertical post 230 of the goal 200, the ground 300, or both. Further, the portable training device 100 can be positioned at any position along the horizontal post 220 of the goal 200 by attaching the portable training device 100 to only the horizontal post 220 of the goal 200. Still further, the portable training device 100 can be positioned at any position along the vertical posts of the goal by attaching the portable training device 100 to only the vertical post 230 of the goal 200.

Once the portable training device 100 is attached to the goal 200 or otherwise positioned near the goal opening 210, the individual can shoot a ball 400 at the target area of the portable training device 100. The non-linear section 110 substantially imitates the reach of a goalkeeper 500 thereby permitting the individual to simulate the presence of the goalkeeper 500 without having the goalkeeper 500 present. When the ball 400 passes through the target area, the positive feedback mechanism 140, if present, is activated to provide positive feedback to the individual.

A portable training device 100 and training method has been disclosed. The portable training device 100 includes a non-linear section 110. The non-linear section 110 is configured to a target area that substantially imitates the reach of a goalkeeper 500. The training method includes covering a portion of an opening of a goal 200 with the portable training device 100 to create a target area configured to substantially imitate the reach of a goalkeeper 500.

Any reference to patents, documents and other writings contained herein shall not be construed as an admission as to their status with respect to being or not being prior art. Unless the meaning is clearly to the contrary, all ranges set forth herein are deemed to be inclusive of the endpoints. Although the present invention and its advantages have been described in detail, it is understood that the array of features and embodiments taught herein may be combined and rearranged in a large number of additional combinations not directly disclosed, as will be apparent to one having ordinary skill in the art. The invention disclosed herein may be practiced in the absence of any element which is not specifically disclosed herein. It should be understood that various changes, substitutions and alterations can be made herein without departing from the spirit and scope of the invention as defined by the following claims. There are, of course, other embodiments, which are alternatives to the foregoing descriptions of the invention, which are intended to be included within the scope of the invention, as defined by the following claims.

What is claimed is:

1. A portable training device for a goal, the portable training device comprising:

a. a first support member;

b. a second support member connected to the first support member at a first angle of about 90 degrees;

c. a non-linear section connected to the first support member and the second support member; and d. a target comprising a mouth comprised of the first support member, the second support member, and the non-linear section; an end opposite said mouth and a net extending from said mouth to said end opposite said mouth, wherein said net forms a passage between said mouth and said end and contains no exit as large or larger than said mouth between said mouth and said end; wherein the non-linear section comprises at least one peak oriented toward the mouth, said peak having a radius of curvature of at least about 10 to 20 inches.

2. The portable training device for a goal of claim 1, wherein the first support member comprises a vertical post of the goal.

3. The portable training device for a goal of claim 2, wherein the second support member comprises a horizontal post of the goal.

4. The portable training device for a goal of claim 2, wherein the second support member comprises a substantially horizontal surface.

5. The portable training device for a goal of claim 1, wherein the net comprises a positive feedback mechanism.

6. The portable training device for a goal of claim 1, wherein the peak has a radius of curvature of at least about 12 to 18 inches.

7. The portable training device for a goal of claim 1, wherein a second angle of at least about 90 degrees is formed where the non-linear section attaches to the first support member.

8. The portable training device for a goal of claim 7, wherein a third angle of at least about 90 degrees is formed where the non-linear section attaches to the second support member.

9. The portable training device for a goal of claim 5 further comprising a stabilization member configured to permit the portable training device to be self-supporting.

10. The portable training device for a goal of claim 1, wherein the non-linear section is a non-linear support member.

11. The portable training device for a goal of claim 1, further comprising a ground stake, the second support member being secured to the ground by the ground stake.

12. The portable training device for a goal of claim 11, wherein the target end has an open position and a closed position, whereby a soccer ball may pass through the net when the target end is in the open position, and a soccer ball will be retained by the net when the target end is in the closed position.

13. The portable training device for a goal of claim 1, wherein the target end has an open position and a closed position, whereby a soccer ball may pass through the net when the target end is in the open position, and a soccer ball will be retained by the net when the target end is in the closed position.

14. The portable training device for a goal of claim 13, wherein the net comprises a drawstring to secure the target end in the closed position.

15. The portable training device for a goal according to claim 1 further comprising a stake configured to secure said training device to the ground.

16. The portable training device for a goal of claim 15 further comprising at least one band configured to elastically secure said training device to an object selected from said stake and said goal.

17. The portable training device for a goal of claim 16 wherein said at least one band is a bungee cord.

* * * * *